United States Patent [19]

Hammerschlag

[11] 4,224,776

[45] Sep. 30, 1980

[54] MEZZANINE SUPPORT BEAM FOR MULTI-STORY HOOK-IN TYPE SHELVING

[75] Inventor: Peter G. Hammerschlag, Bellevue, Wash.

[73] Assignee: Easy Up Shelving, Inc., Seattle, Wash.

[21] Appl. No.: 874,062

[22] Filed: Feb. 1, 1978

[51] Int. Cl.[2] ..... E04H 12/18

[52] U.S. Cl. ..... 52/645; 211/187; 211/190

[58] Field of Search ..... 52/646, 645, 648, 637, 52/721, 732; 211/187, 189, 190, 191, 192, 207, 208; 248/243

[56] References Cited

U.S. PATENT DOCUMENTS

| | | | |
|---|---|---|---|
| 3,263,821 | 8/1966 | Klene et al. | 211/190 |
| 3,358,848 | 12/1967 | Johnsson | 52/721 X |
| 3,846,944 | 11/1974 | Lambert | 248/243 X |

*Primary Examiner*—James A. Leppink
*Assistant Examiner*—Carl D. Friedman

[57] ABSTRACT

A z-shaped beam for hook-in type shelving systems that can support mezzanine floors and walkways either with its top flange or its bottom flange, and in the latter case can act at the same time as kickplate and/or shelf-support while supporting the edge of the floor structure, thus allowing a series of these z-beams to completely support a floor structure by forming two sets of perpendicular beams, the distance between these beams being no more than the distance between posts.

3 Claims, 3 Drawing Figures

MEZZANINE SUPPORT BEAM FOR MULTI-STORY HOOK-IN TYPE SHELVING

BACKGROUND OF THE INVENTION

This invention relates to shelving systems consisting of vertical posts with slots or holes and horizontal components with hooks or buttons going into these slots or holes.

As many warehouses are high enough to accomodate two or more stories of shelving, there is a need for a simple way to build up shelving systems of two or more stories that use the upright posts of the shelving to support mezzanine floors and walkways, thus saving the large expense of having to put in conventional intermediate floors supported by walls or independent posts. Shelving Systems allowing incorporation of mezzanine floors and walkways are known, usually using L-shaped and U-shaped member for this purpose, see for instance Lambert, U.S. Pat. No. 3,846,944, but they require a substantial number of different components, particularly when each other crossing walkways and kickboards (to prevent material) from being kicked off walkway or floor) are needed. These kickboards are usually separate members in existing systems. Some of these existing systems use so-called "slotted angle" which has to be sawed to size to make up a system. Generally, all the existing systems need a large number of pieces of different cross-section and length and are time-consuming to assemble.

SUMMARY OF THE INVENTION

In view of the foregoing it is the object of the present invention to allow easy assembly of mezzanine floors and walkways in hook-in type shelving systems by providing a z-shaped beam that can be hooked into the slots or holes of upright shelving posts, this beam being shaped such that it can support a mezzanine floor with its upper flange, while another z-shaped beam with identical cross-section can support the edge of the same floor with its lower flange by being hooked into the post at a higher level, thus allowing easy construction of two sets of supporting beams prependicular to each other, tying all the posts together into a rigid horizontal frame for supporting the mezzanine floor, while at the same time the webs of the z-beams, whose lower flanges are used for supporting the edges of the floor, can act as kickboards (to prevent material to be kicked off the mezzanine floor or walkways to a lower floor), and the upper flanges of these z-beams can support and retain shelving boards where desired, this retaining being accomplished by tabs formed by precut slots in the upper flanges, these tabs being bent up when needed for retaining shelves.

The foregoing and other objects, features and advantages of the present invention will be apparent from the following detailed description of a preferred embodiment of the invention as illustrated in the accompanying drawings.

DESCRIPTION OF THE PREFERRED EMBODIMENT

Figure 1:
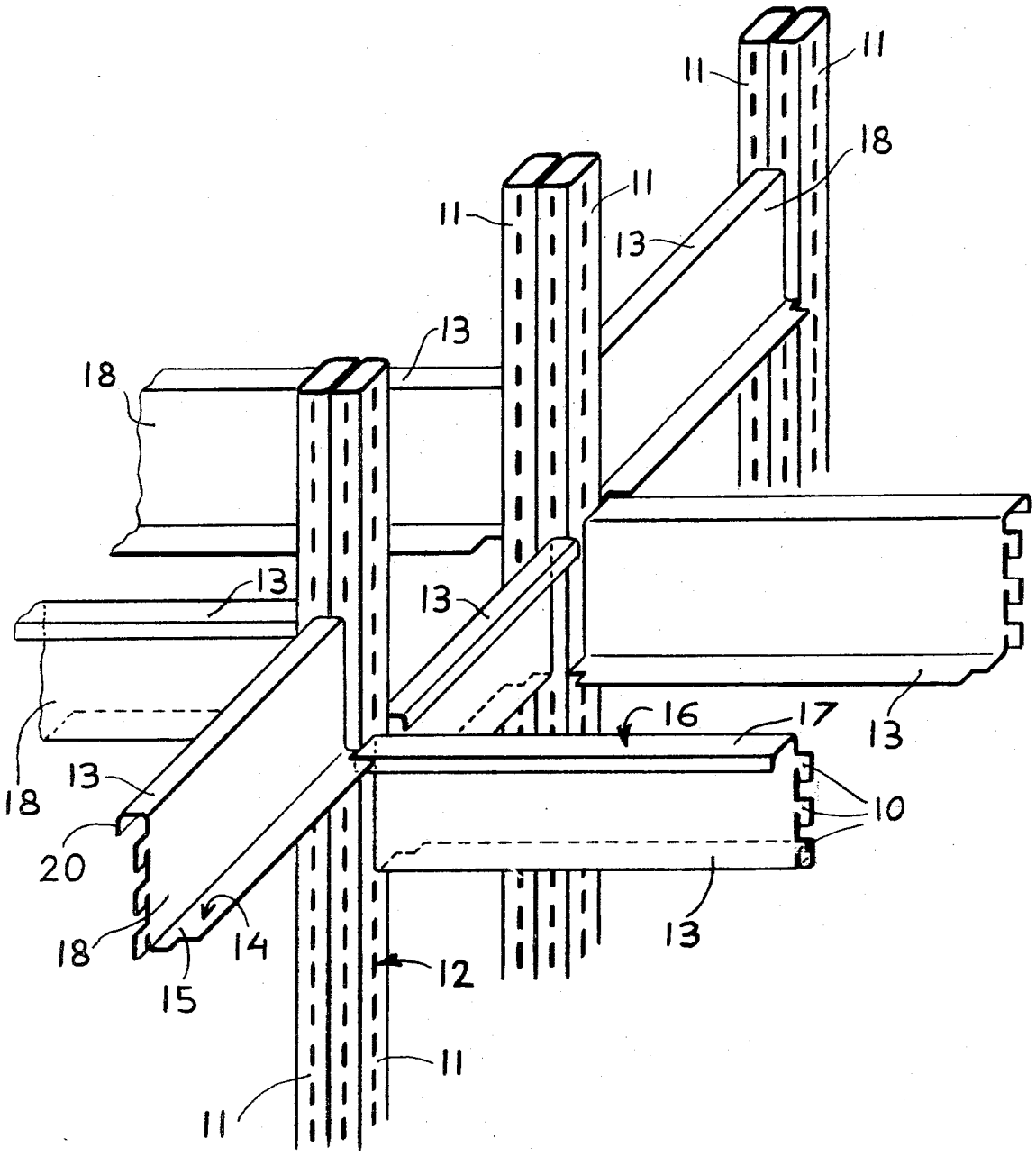
FIG. 1 is an oblique drawing of a section of shelving showing posts tied together in two perpendicular directions by z-beams per this invention.
Figure 2:
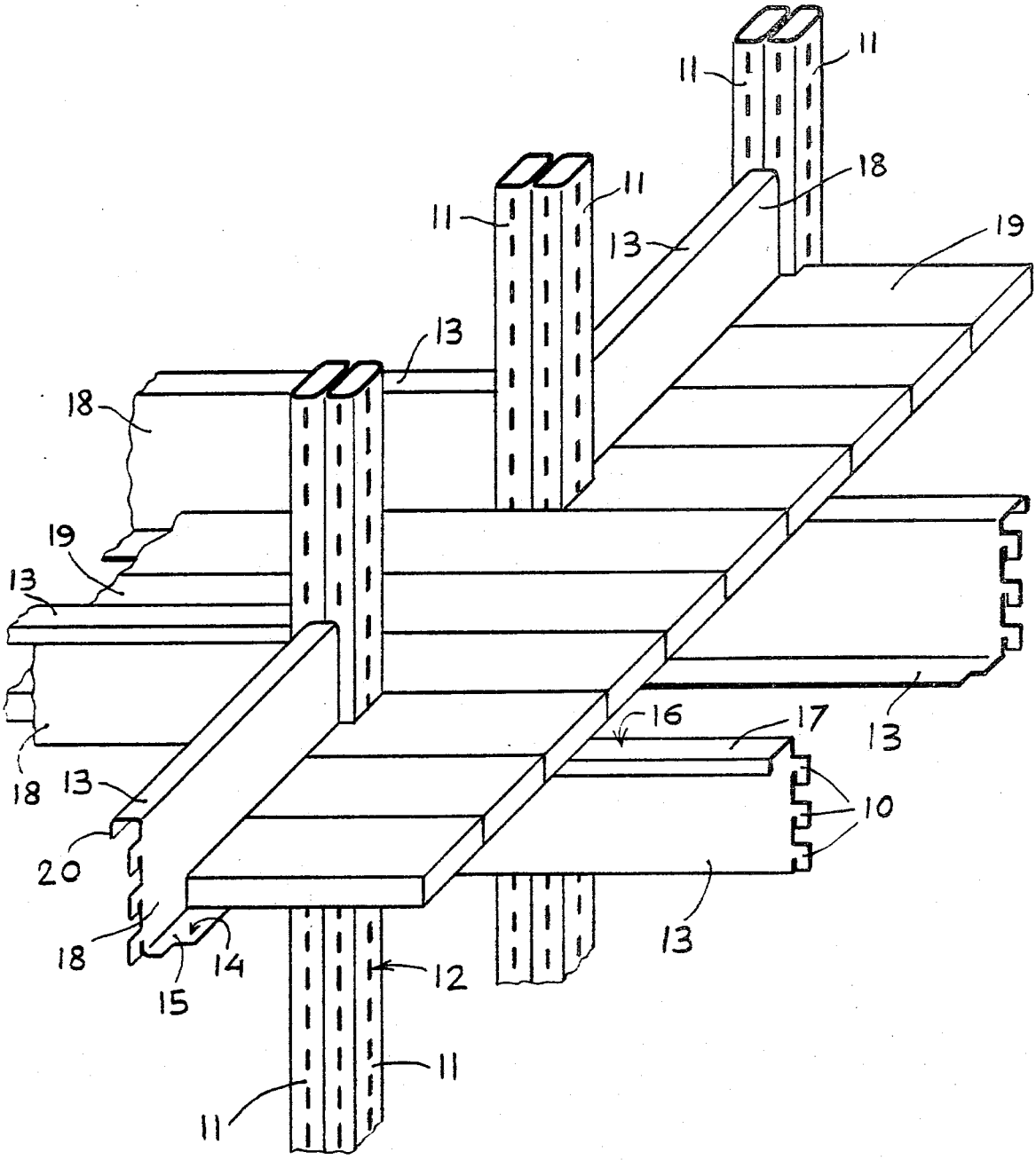
FIG. 2 is an oblique drawing of the same section of shelving shown in FIG. 1, but with a deck consisting of wooden planks on top of the two sets of perpendicular z-beams per this invention, some of these z-beams supporting the deck with their upper flange and others with their lower flange.
Figure 3:
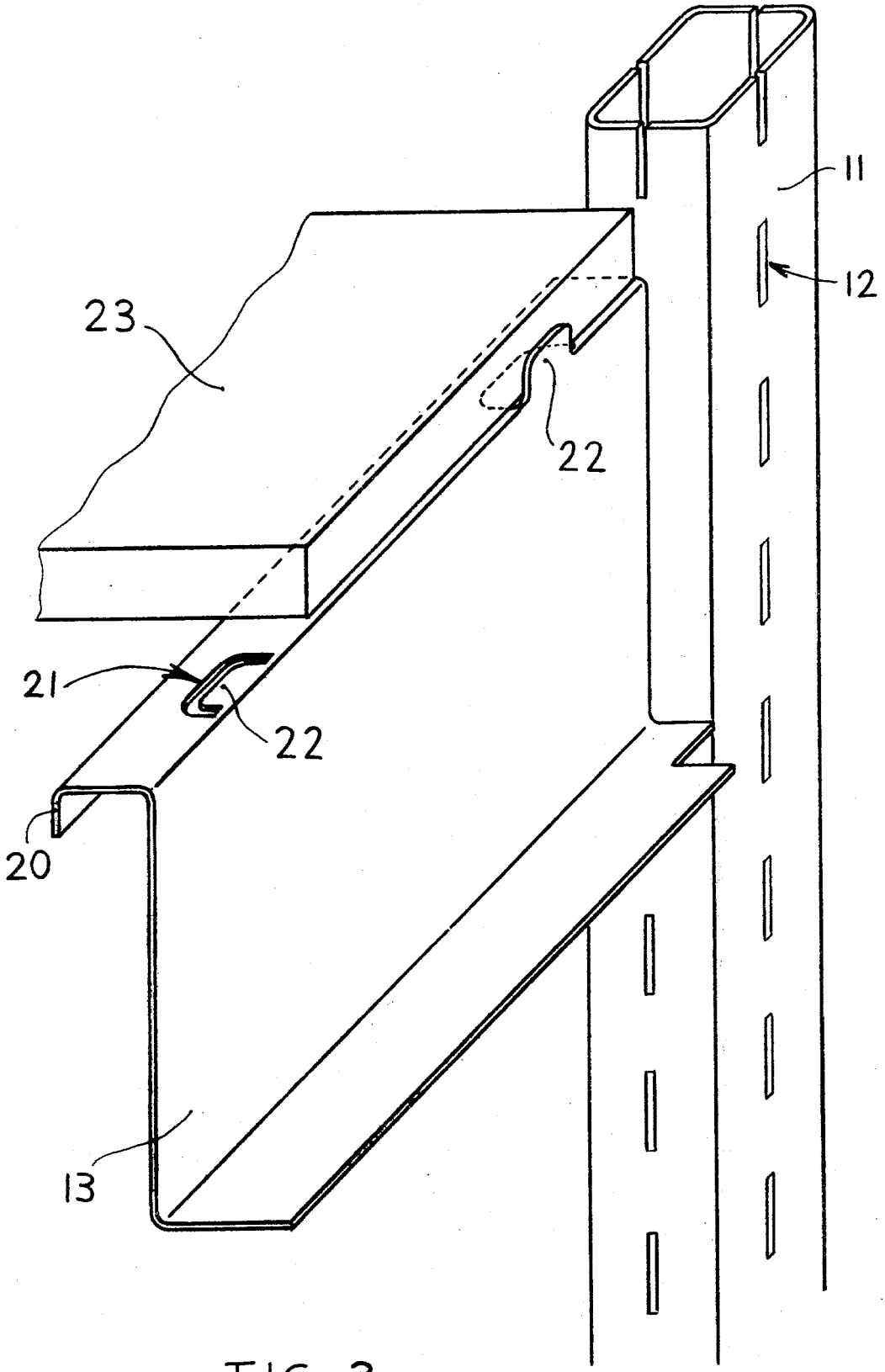
FIG. 3 is an oblique drawing of a z-beam showing how bent-up retaining tabs on the z-beam can retain shelves.

The preferred embodiment will now be described referring to FIGS. 1,2 and 3. Shown are posts 11 with vertical slots 12 as used for hook-in type shelving. Single posts can be used, but for added strength several posts can be tied together. In FIG. 1 and 2 double posts are shown; the bolts or other means holding them together are omitted for clarity reasons.

In FIG. 1 two sets of z-beams 13 are shown, one set perpendicular to the other, so that a rigid framework is formed by the z-beams together with the posts. All these z-beams have the same cross-section and differ only from each other in length, thus reducing the amount of tooling needed to manufacture them.

The height of the z-beam is such that two z-beams can be hooked into the posts at different heights such that the top surface 14 of the lower flange 15 of the upper z-beam is at the same horizontal level as the top surface 16 of the upper flange 17 of the lower z-beam. To accomplish this the upper and lower flange of the z-beam are spaced apart a distance a whole number times the distance between the centers of the slots or holes in the posts. This allows the construction of any shape of mezzanine flooring, including walkways between rows of shelving—as long as the edges of the flooring are straight lines between posts—, this flooring being fully supported in two perpendicular directions by z-beams not farther apart than the distance between posts, while the edges of the flooring can all be supported by lower flanges of z-beams so that the webs 18 of the z-beams at the edges can function as "kick-boards", preventing material from being kicked off the mezzanine flooring onto a lower floor.

The following panels can be wooden planks 19 as shown in FIG. 2, steel grating panels or other flooring materials. It can be seen in FIG. 2, which shows part of a perpendicular crossing of two mezzanine walkways, how the planks 19 can be laid either crosswise to the walkways, supported by the lower flanges of the z-beams on the sides of the walkways or can be laid lengthwise to the walkways supported by the upper flanges of the z-beams across the walkways. Thus all planks, regardless of the directions of the various walkways can be laid in the same direction, as shown in FIG. 2, eliminating the need for special components for walkway crossings. In FIG. 3 is shown on a larger scale than in FIG. 1 a z-beam 13 hooked into a post 11. In the part of the z-beam towards the viewer is shown how a slot 21 in the upper flange of the z-beam can create a tab 22. In the part of the z-beam away from the viewer is shown how such tabs 22 can be bent up, for instance with a screw driver, and retain shelves 23.

The posts as well as the z-shaped beams can be made from sheet metal, plastics or other materials. The upper flanges of the z-shaped beams can be stiffened by a short downward extension 20 as shown in FIG. 1 FIG. 2 and FIG. 3. The posts can be rectangular tubes with series of vertical slots or holes on the four sides as shown in the illustrations, but they can also be triangular tubes, channel sections, angle sections or any other shape with only three, two or even one series of vertical slots or holes, as long as enough posts can be tied together where needed to allow construction of a rigid and strong enough support structure for the flooring.

It must also be mentioned that the web and the flanges of the z-beams can be provided with holes or hole and slot patterns as used for instance in so-called "slotted-angle", allowing attachment with bolts and nuts or other fasteners of miscellaneous items like light fixtures and sprinkler installations.

While the invention has been described and illustrated herein with reference to the preferred embodiment thereof, it will be understood by those skilled in the art that various changes in form and details may be made therein without departing from the spirit and scope of the invention.

More specifically it is to be pointed out that where the drawings show three hooks on each end of a z-beam this can be also two hooks, a single hook or four or more hooks per beam end. Also these hooks can have various shapes, including button type protrusions as shown for instance in FIG. 3 of Lambert, U.S. Pat. No. 3,846,944.

What is claimed is:

1. A multi-story shelving assembly comprising:

(a) posts having a plurality of openings, said openings spaced from each other along the post;

(b) z-shaped beams having a web portion, a number of projections from said web and spaced apart such that they can be received into the openings of the posts;

(c) flooring panels; said z-shaped beams having an upper and a lower flange spaced apart from each other a distance a whole number times the distance between the openings in the posts, and the hooks such that one z-shaped beam can be hooked into one group of openings in a post, and another z-shaped beam with identical cross-section can be hooked into another group of openings in a post, such that the top surface of the upper flange of one z-shaped beam is at the same horizontal level as the top surface of the lower flange of the other z-shaped beam, allowing support of the flooring panels simultaneously by both the upper flange of the first z-shaped beam and the lower flange of the second z-shaped beam.

2. A multi-story shelving assembly as claimed in claim 1, wherein the z-shaped beams have shelf retaining means.

3. A multi-story shelving assembly as claimed in claim 2, wherein said shelf retaining means consists of tabs preformed into the upper flange of the z-shaped beam by cutting a slot in said upper flange, these tabs being bent up when needed for retaining into a plane approximately perpendicular to the plane of the upper flange of the z-shaped beam.

* * * * *